US010655615B2

(12) United States Patent
Smith et al.

(10) Patent No.: US 10,655,615 B2
(45) Date of Patent: May 19, 2020

(54) HIGH PRESSURE FLUID SYSTEM

(71) Applicant: FINISHING BRANDS UK LTD., Bournemouth Dorset (GB)

(72) Inventors: Alan Smith, West Moors (GB); Nigel Wood, West Moors (GB)

(73) Assignee: Finishing Brands UK LTD., Bournemouth (GB)

( * ) Notice: Subject to any disclaimer, the term of this patent is extended or adjusted under 35 U.S.C. 154(b) by 188 days.

(21) Appl. No.: 15/563,458

(22) PCT Filed: Mar. 30, 2016

(86) PCT No.: PCT/GB2016/050884
§ 371 (c)(1),
(2) Date: Sep. 29, 2017

(87) PCT Pub. No.: WO2016/156833
PCT Pub. Date: Oct. 6, 2016

(65) Prior Publication Data

US 2018/0128251 A1 May 10, 2018

(30) Foreign Application Priority Data

Mar. 31, 2015 (GB) ..... 1505551.0

(51) Int. Cl.
*F04B 15/02* (2006.01)
*F04B 17/03* (2006.01)
(Continued)

(52) U.S. Cl.
CPC ..... *F04B 15/02* (2013.01); *B05B 9/0423* (2013.01); *F04B 17/03* (2013.01); *F04B 49/06* (2013.01);
(Continued)

(58) Field of Classification Search
CPC ..... B05B 12/04; B05B 9/0406; B05B 9/0423; F04B 15/02; F04B 2015/026
See application file for complete search history.

(56) References Cited

U.S. PATENT DOCUMENTS 5,035,580 A 7/1991 Simonette
5,040,732 A 8/1991 Anderson et al.
(Continued)

FOREIGN PATENT DOCUMENTS

CN 103492083 A 1/2014
GB 864188 A 3/1961
(Continued)

OTHER PUBLICATIONS

Russian Office Action for Ru Application No. Ru 2017134501 dated Aug. 21, 2018, 14 pgs.
(Continued)

*Primary Examiner* — Kenneth J Hansen
(74) *Attorney, Agent, or Firm* — Fletcher Yoder, P.C.

(57) ABSTRACT

A system for delivery of a high viscosity fluid comprises a variable speed pump. A circuit through which the fluid is pumped comprises a loop having a plurality of fluid off-takes from the circuit. A controller controls the operation and speed of the pump, (i) such that the pump pumps the fluid in the circuit in a high pressure mode in which fluid flows from the pump to the fluid off-takes through both ends of the loop. During the high pressure mode, the controller controls the speed of the pump to maintain the pressure of the fluid in the circuit. The controller also controls the operation and speed of the pump, (ii) such that the pump pumps the fluid around the circuit in a low pressure mode during periods when none of the fluid off-takes are being used.

18 Claims, 5 Drawing Sheets

(51) Int. Cl.

| | |
|---|---|
| ***F04B 49/20*** | (2006.01) |
| ***F04B 49/06*** | (2006.01) |
| ***B05B 9/04*** | (2006.01) |

(52) U.S. Cl.

CPC ..... *F04B 49/20* (2013.01); *F04B 2203/0209* (2013.01); *F04B 2205/05* (2013.01)

(56) References Cited

U.S. PATENT DOCUMENTS

| | | | | |
|---|---|---|---|---|
| 5,058,805 | A | 10/1991 | Anderson et al. | |
| 5,401,140 | A | 3/1995 | Anderson | |
| 5,433,587 | A | 7/1995 | Bankert et al. | |
| 2007/0075163 | A1* | 4/2007 | Smith ..... | B05B 9/0423 239/124 |

FOREIGN PATENT DOCUMENTS

| | | | |
|---|---|---|---|
| JP | S5084901 | A | 7/1975 |
| JP | S5211227 | A | 1/1977 |
| JP | S6372374 | A | 4/1988 |
| JP | H0326368 | U | 3/1991 |
| JP | H386059 | U | 8/1991 |
| WO | 2009101039 | A1 | 8/2009 |

OTHER PUBLICATIONS

V.V. Pankratov, Vector Control of Asynchronous Electric Drives, A Textbook for Students of 4-5 Courses EFM, Novosibirsk, 1999, p. 30-66.

Chinese Office Action for CN Application No. 201680029901.0 dated Nov. 1, 2018, 19 pgs.

Japanese Office Action for JP Application No. 2017-551192 dated Nov. 6, 2018, 8 pgs.

Korean Office Action for KR Application No. 10-2017-7029758 dated Nov. 25, 2018, 9 pgs.

Canadian Office Action for CA Application No. 2,980,804 dated Jun. 11, 2018, 3 pgs.

International Search Report and Written Opinion for PCT Application No. PCT/GB2016/050884 dated Jun. 8, 2016, 10 pgs.

Japanese Office Action for JP Application No. 2017-551192 dated Aug. 6, 2019, 1 pg.

* cited by examiner

HIGH PRESSURE FLUID SYSTEM

CROSS-REFERENCE TO RELATED APPLICATIONS

This application is a National Stage of PCT Application No. PCT/GB2016/050884 entitled "HIGH PRESSURE FLUID SYSTEM," filed on Mar. 30, 2016, which is herein incorporated by reference in its entirety, and which claims priority to Great Britain Patent Application No. 1505551.0, entitled "HIGH PRESSURE FLUID SYSTEM," filed on Mar. 31, 2015, which is herein incorporated by reference in its entirety.

FIELD OF THE INVENTION

The present invention relates to a high pressure fluid system. More particularly, the invention relates to a system for delivering a thick, highly viscous material such as mastic.

BACKGROUND

Mastic materials are used increasingly as sealants in product manufacturing facilities, particularly in automotive manufacturing. Typically the mastic material will be applied to a product (e.g. parts of a vehicle) as the product is moved through different stages in the manufacturing process, for example at different stations on a production line. When required to apply the mastic, an operator will simply reach for a mastic application gun, which is connected to an off-take on a mastic circuit that is supplied with the mastic at a high pressure. The high pressure is provided by a pump. Conventionally, the pumps used have been hydraulic or pneumatic positive displacement pumps.

However, because mastics are very thick and viscous, the capacity and pressure available from conventional pumps has meant that the circuits have to be short such that the mastic pumps and the reservoirs of the mastic materials being pumped have hitherto had to be located close to the stations where the off-takes are located. A further problem is that the fluids tend to thicken, and may even solidify if left stationary for too long a time, such as overnight or at a week-end when the plant is not being used. On large production lines, these problems have meant that a large number of mastic pumping circuits have been installed close to the points where the mastic is used, with a correspondingly large number of pumps and storage vessels (reservoirs).

Similar problems can arise with other high viscosity fluids, such as epoxy materials or other types of adhesive.

This invention has therefore been conceived to provide an improved high pressure fluid delivery system that overcomes or alleviates the foregoing problems.

SUMMARY

According to a first aspect of the present invention, there is provided a system for delivery of a high viscosity fluid. The system comprises a variable speed pump. A circuit through which the fluid is pumped comprises a loop having a plurality of fluid off-takes from the circuit. A controller controls the operation and speed of the pump, (i) such that the pump pumps the fluid in the circuit in a high pressure mode in which fluid flows from the pump to the fluid off-takes through both ends of the loop. During the high pressure mode, the controller controls the speed of the pump to maintain the pressure of the fluid in the circuit. The controller also controls the operation and speed of the pump, (ii) such that the pump pumps the fluid around the circuit in a low pressure mode during periods when none of the fluid off-takes are being used.

Operating the system in the high pressure mode has the advantage that high pressure fluid is available at all of the off-takes for use in the manufacturing area. Operating the system in the low pressure mode has the advantage that the fluid is kept moving around the system, for example during periods when the plant in the manufacturing area is idle.

In an embodiment of the first aspect, in the low pressure mode, fluid flows from the pump through a first end of the loop and out through a second end of the loop.

In an embodiment of the first aspect, the system is installed in a manufacturing facility, with the fluid off-takes located at locations in a product manufacturing area.

In an embodiment of the first aspect, the variable speed pump is located at a booster station, and the pump has an inlet for receiving fluid from a medium pressure pumping station.

In an embodiment of the first aspect, the medium pressure pumping station comprises a ram unit. The ram unit ensures that fluid is forced to enter the inlets of the pumps, such that the pumps are properly primed.

In an embodiment of the first aspect, the system further comprises an outlet pressure sensor for sensing fluid pressure at the outlet of the pump. The outlet pressure sensor provides a signal representing a sensed pressure to the controller, and the controller controls the speed of the pump based on the sensed outlet fluid pressure.

In an embodiment of the first aspect, the system further comprises a pressure switch responsive to fluid pressure at the outlet of the pump to confirm that operation of the pump is providing a fluid pressure below a maximum working pressure of the pump.

In an embodiment of the first aspect, the variable speed pump is an ac motor driven positive displacement pump.

In an embodiment of the first aspect, the ac motor is driven by an inverter. Preferably the inverter has a vector drive control, which may be a closed loop vector drive control.

According to a second aspect of the present invention, there is provided a method of operating a high viscosity fluid delivery system. The system comprises a circuit through which the fluid is pumped, a variable speed pump, and a plurality of fluid off-takes from the circuit. The method comprises a first step of (i) controlling the operation and speed of the pump, such that the pump pumps the fluid in the circuit in a high pressure mode to provide pressurised fluid to the off-takes. During the high pressure mode, the speed of the pump is controlled to maintain the pressure of the fluid in the circuit. The method comprises a second step of controlling the operation and speed of the pump, such that the pump pumps the fluid around the circuit in a low pressure mode during periods when none of the fluid off-takes are being used.

In an embodiment of the second aspect, the fluid off-takes are off-takes from a loop in the circuit, and in the high pressure mode the fluid is pumped into the loop through both ends of the loop.

In an embodiment of the second aspect, in the low pressure mode, the fluid is pumped through a first end of the loop and out through a second end of the loop.

In an embodiment of the second aspect, the system comprises a pressure sensor monitoring a pressure of the fluid at an outlet of the pump. The method further comprises, in the high pressure mode, a step of detecting, by the pressure sensor, a drop in fluid pressure at the pump outlet below a pre-set fluid pressure. The method further comprises, in the high pressure mode, starting the pump, or increasing the speed of the pump, and restoring the pressure of the fluid at the pump outlet to the pre-set value.

In an embodiment of the second aspect, the method further comprises the step of detecting, using the pressure sensor, that the fluid at the pump outlet has been restored to the pre-set value. The method further comprises the steps of reducing the speed of the pump to zero and, while the pump is at zero speed, using the pump to maintain a force on the fluid for a predetermined period of time.

According to a third aspect of the present invention, there is provided a system for delivery of a high viscosity fluid. The system comprises: a medium pressure pumping station; a booster station comprising a variable speed pump having an inlet receiving fluid from the medium pressure pumping station; a circuit through which the fluid is pumped; a plurality of fluid off-takes from the circuit; and a controller. The controller controls operation and speed of the pump (i) to pump the fluid in the circuit in a high pressure mode to provide pressurised fluid to the off-takes and wherein the controller controls the speed of the pump to maintain the pressure of the fluid in the circuit, and (ii) to pump the fluid around the circuit in a low pressure mode during periods when none of the fluid off-takes are being used.

The medium pressure pumping station may comprise a ram unit.

According to a fourth aspect of the present invention there is provided a method of operating a high viscosity fluid delivery system. The system comprises a medium pressure pumping station, a booster station comprising a variable speed pump, a circuit through which the fluid is pumped, and a plurality of fluid off-takes from the circuit. The method comprises: (i) pumping fluid from the medium pressure pumping station to the booster station; (ii) controlling the operation and speed of the variable speed pump to pump the fluid in the circuit in a high pressure mode to provide pressurised fluid to the off-takes and to control the speed of the variable speed pump to maintain the pressure of the fluid in the circuit, and (iii) controlling the operation and speed of the variable speed pump to pump the fluid around the circuit in a low pressure mode during periods when none of the fluid off-takes are being used.

DETAILED DESCRIPTION

Figure 1:
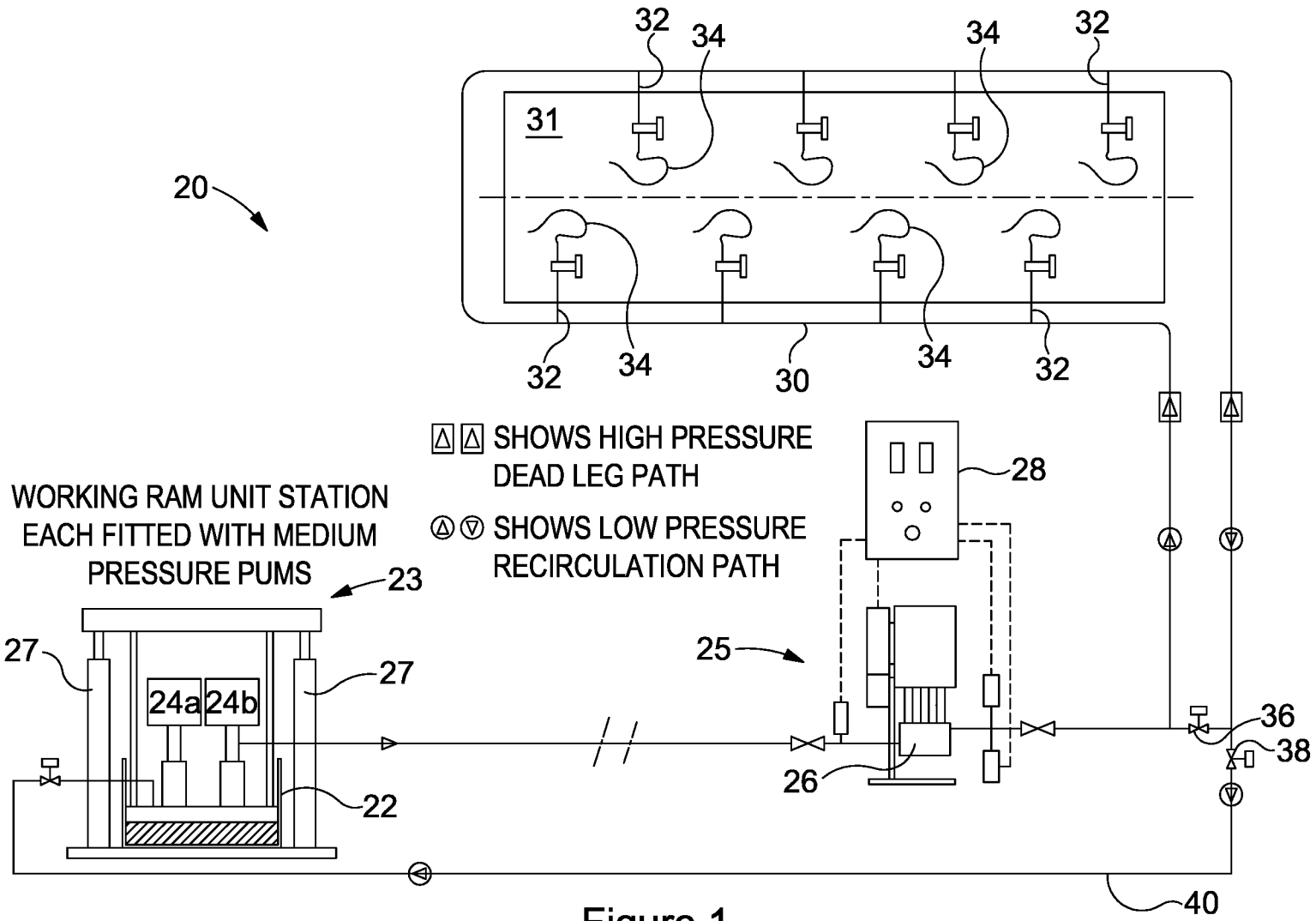
FIG. 1 is a schematic layout of a high pressure fluid delivery system in a manufacturing facility in accordance with aspects of the invention.

Referring to FIG. 1, there is shown a schematic diagram of an example embodiment of a high pressure system suitable for delivery of a fluid such as mastic. The system includes a circuit 20 around which the fluid is circulated. A number of pumps 24, 26 are used to pump the fluid. As shown, the pumps are arranged in two pumping stages. A first pumping stage includes a working medium pressure pumping station 23 including two medium pressure pumps 24*a*, 24*b*.

As shown in FIG. 1, the medium pressure pumping station 23 is in the form of a ram unit, in which a vessel 22 (usually cylindrical) containing the mastic fluid is mounted. The pumps 24*a*, 24*b* are mounted in a fixed position, which is initially on top of a full vessel 22. When the fluid is pumped, rams 27 apply pressure to the fluid within the vessel 22 so that the fluid is forced to enter the inlets of the pumps 24*a*, 24*b*, thereby ensuring that the pumps are properly primed. Typically a pair of such medium pressure pumping stations 23 will operate in tandem, with, at any time one station pumping and the other on standby. Generally the working medium pressure pumping station 23 will operate until the ram unit reaches the top of its travel and the vessel 22 is almost empty. At that time the standby medium pressure pumping station will take over while the vessel 22 in the (previously) working station 23 is replenished or replaced with a full vessel.

A second pumping stage acts as a booster station 25 that includes a high pressure pump 26, an example of which will be described in more detail below. The second pumping stage has an outlet 29 through which fluid is pumped into and/or around the circuit 20.

The circuit 20 also includes a loop 30, which typically passes around a manufacturing area 31, and has take-offs 32, each leading to a line 34 from which an operator or controlled machine, such as a robot, can operate an applicator (not shown), such as a mastic gun, to apply fluid when required to product parts in the manufacturing area 31. The circuit 20 includes a return line 40 back from the loop 30 to the medium pressure pumping station 23. A link valve 36 is provided in a short connecting line between the start of the loop 30 (at a point after the outlet 29 of the pump 26) and the end of the loop before the return line 40. A stop valve 38 in the return line 40 can be closed to prevent flow between the loop 30 and the return line 40.

Figure 2A:
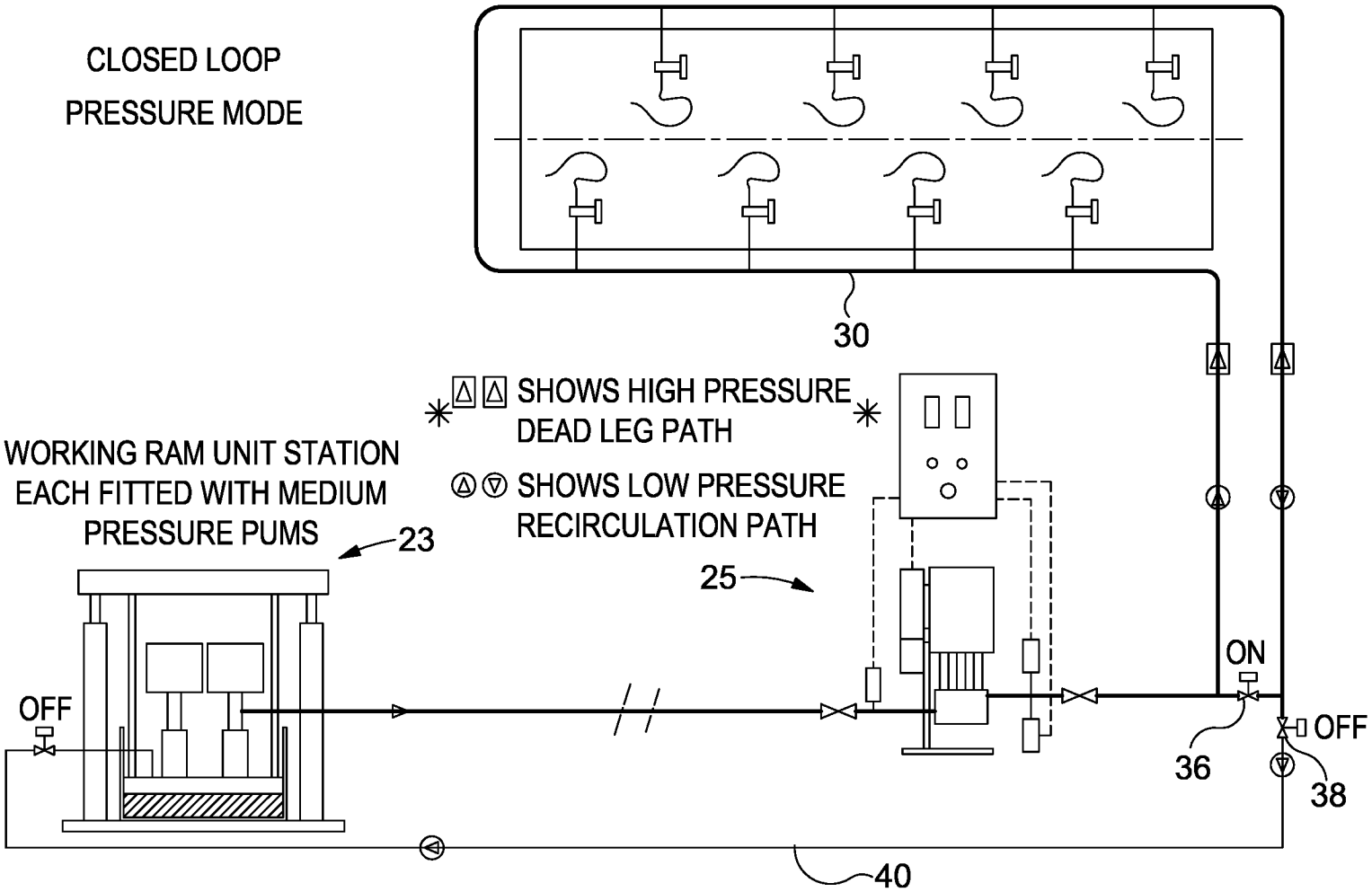
FIG. 2*a* shows the layout of FIG. 1 with a flow path for a high pressure mode of operation highlighted.

The system is configured to operate in either a high pressure mode or a low pressure, recirculation mode. In the high pressure mode the link valve 36 is opened and the stop valve 38 is closed. FIG. 2*a* shows the layout of FIG. 1 with the flow path for the high pressure mode of operation highlighted. In this mode the pumps pump fluid into the loop 30 from both ends. This ensures that high pressure fluid is available at all of the off-takes 32 for use in the manufacturing area 31.

Figure 2B:
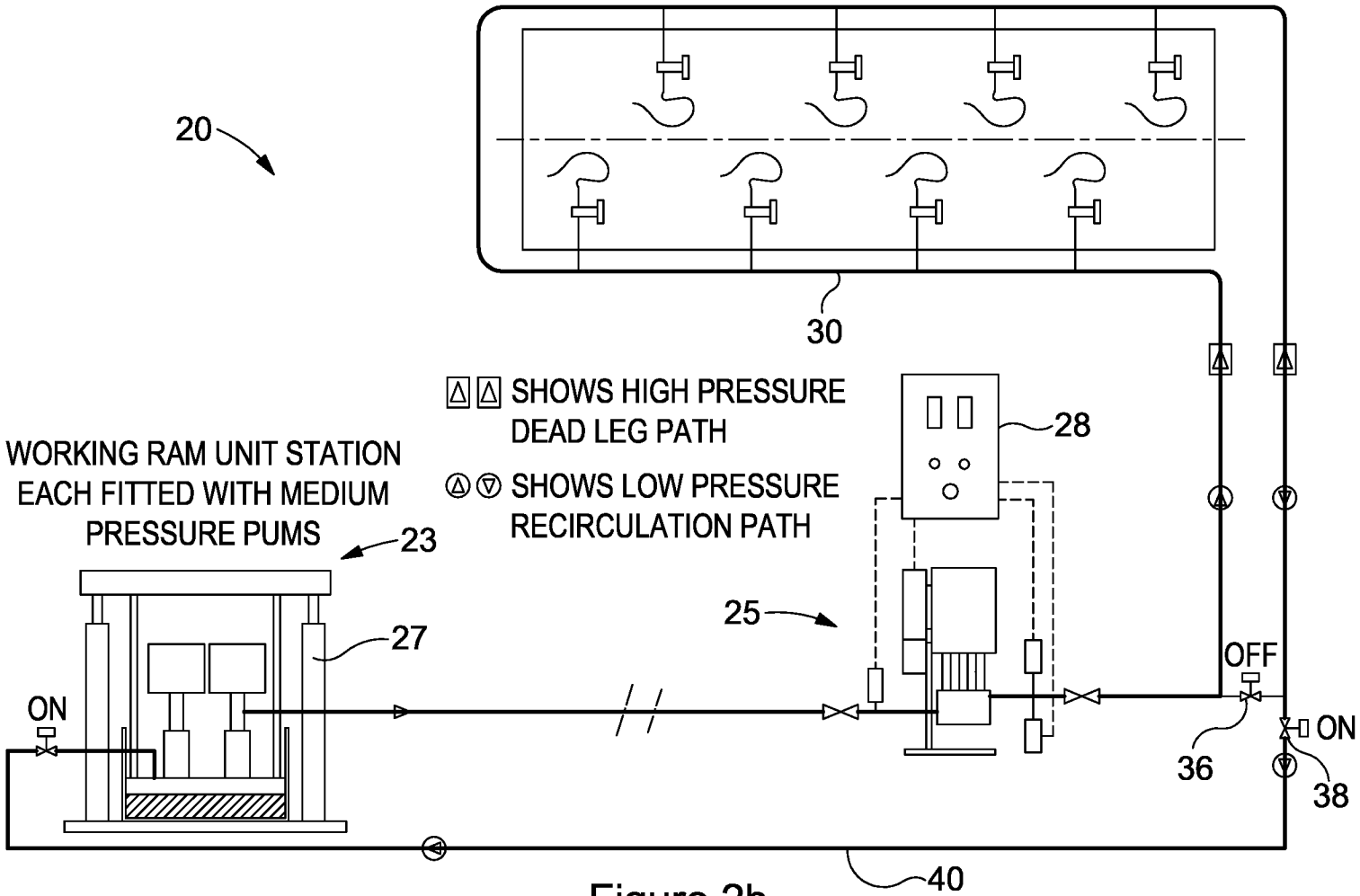
FIG. 2*b* shows the layout of FIG. 1 with a flow path for a low pressure, recirculation mode of operation highlighted.

In the low pressure, recirculation mode, the link valve 36 is closed and the stop valve 38 is opened. In this mode the pumps pump fluid at a lower pressure around the loop 30 and back through the opened stop valve 38 and return line 40 to the medium pressure pumping stations 23. FIG. 2*b* shows the layout of FIG. 1 with the flow path for a low pressure, recirculation mode of operation highlighted. This ensures that the fluid is kept moving around the system, for example during periods when the plant in the manufacturing area 31 is idle.

In an alternative arrangement, in the high pressure mode the fluid is pumped into and around the loop in one direction—i.e. from one end only. In this case, the stop valve 38 remains closed and the link valve 36 is also closed (or may be dispensed with entirely).

Operation of the system is controlled by a controller 28. The controller 28 controls the speed of the pump 26 to pump the fluid/mastic around the circuit 20 in the high pressure mode during periods when one or more of the off-takes 32 are being used. In this mode the controller controls the speed of the pump 26 to maintain the pressure of the fluid/mastic in the loop 30. The controller also controls the pump 26 to pump fluid/mastic around the circuit 20 in a low pressure mode during periods when none of the off-takes 32 are being used.

Figure 3:
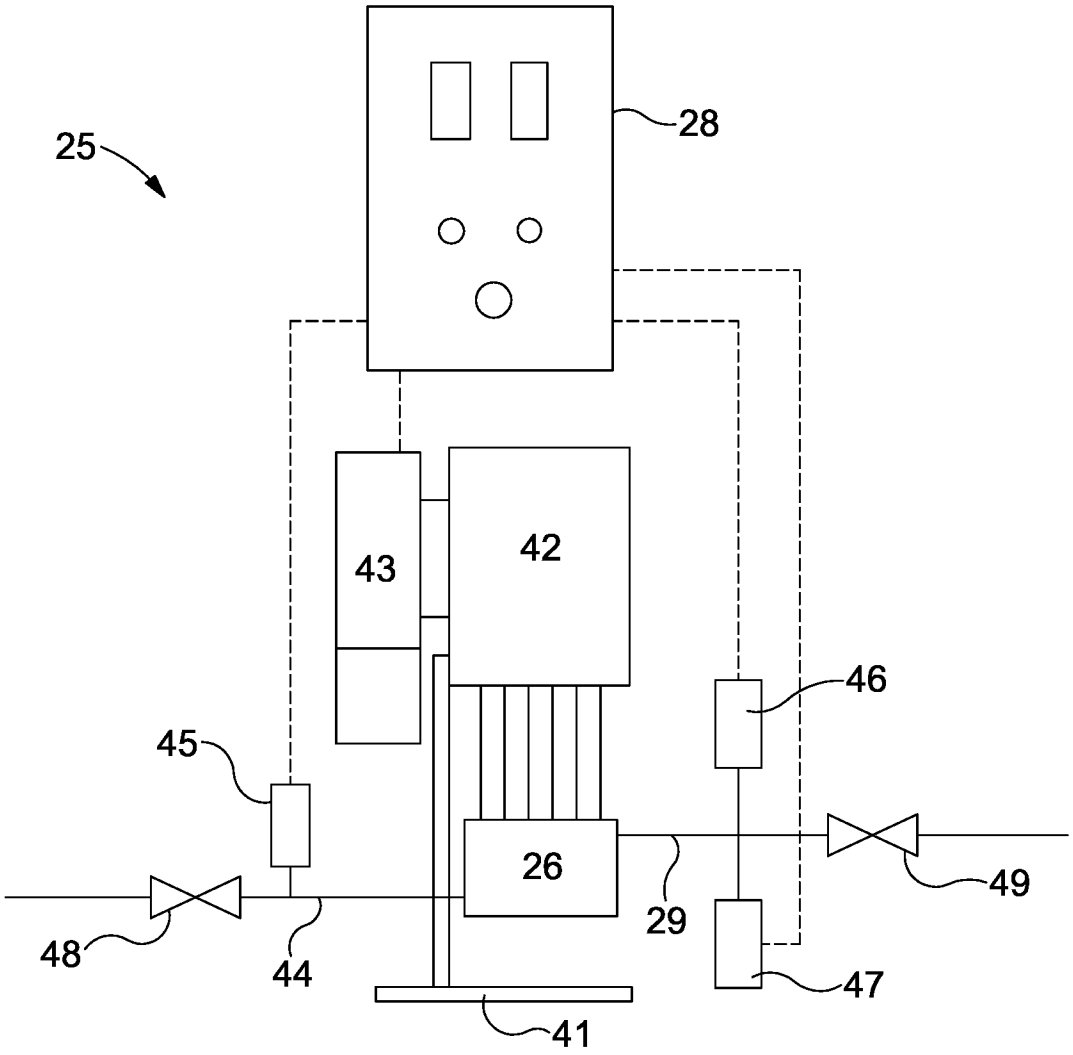
FIG. 3 is a schematic illustration showing more detail of a booster station of the system of FIG. 1 including a high pressure pump and associated controls

FIG. 3 illustrates more detail of the booster station 25, with high pressure pump 26. The high pressure pump 26 may typically be a positive displacement pump with pistons that reciprocate inside cylinders for pumping the fluid. The pistons are driven by a drive unit 42 (an example of which is described below in association with the pump illustrated in FIG. 3). The drive unit is coupled to a variable speed motor 43, which in the example of FIG. 4 described below is an ac motor. The operation and speed of the motor is controlled from a control panel 28, which houses a controller (such as a programmable controller, computer, etc.) and an inverter. As shown in FIG. 3, the pump 26, drive unit 42 and motor 43 are supported on a floor mounted frame 41.

The pump 26 has an inlet 44 through which fluid is received from the medium pressure station 23 (see FIG. 1), and an outlet 29 as described above with reference to FIG. 1. An inlet pressure sensor 45 monitors fluid pressure at the pump inlet 44. An outlet pressure sensor 46 monitors fluid pressure at the pump outlet 29. The inlet pressure sensor 45 ensures that there is sufficient pressure in the fluid at the inlet 44 before the pump 26 starts pumping (i.e. that the pump 26 is primed). There is also a pressure switch 47 at the pump outlet which provides a safety feature to ensure that the pump does not continue pumping in the high pressure mode if a certain maximum pressure of the pump occurs. Signals from the pressure sensors 45, 46 and pressure switch 47 are provided to the controller in control panel 28. A valve 48 before the pump inlet 44 and another valve 49 at the pump outlet 29 can be used to isolate the booster station (e.g. for maintenance or repair purposes).

Note that when operating in the high pressure mode, there may be short periods when production in the manufacturing area requires no, or very little, use of the fluid/mastic. At such periods the pumps, particularly the high pressure pump 26, may be required to operate at extremely low speeds, or even to be stationary, while still applying pressure to the fluid/mastic. The pumps that are described below have been developed to be particularly suitable for this type of operation. However, alternative pumps or pumping arrangements cold be used in a system similar to that shown in FIG. 1.

Referring to FIGS. 1 and 2*a* and 3, in the high pressure mode, the pump 26 and its controller keep the pressure at the outlet of the pump 26 at a pre-set value, independent of the flow rate of the pump 26, as in a true pressure closed loop control system. Thus, at times when the fluid (e.g. mastic) is being used, or must be available for use in the manufacturing area 31, the controller controls the pump to maintain the fluid pressure in the loop 30. If the outlet pressure sensor 46 detects a drop in pressure, the controller starts the pump 26, or if it is already running, increases the speed of the pump 26 to restore the outlet pressure to the pre-set value. When the fluid is actually being used at the off-takes 34 in the manufacturing area 31, the motor 43 drives the drive unit 42 to move the pistons in the pump 26 and cause the fluid to be pumped into the loop 30. When use of the off-takes 34 ceases the controller still provides power to the motor for a short time to exert a torque on the drive unit that is transferred into a force on the pistons in the pump 26 so as to maintain pressure on the fluid in the loop 30. If there is then no further drop in outlet pressure detected by the sensor 46, the controller switches off the pump 26. While the operating mode remains the high pressure mode, the controller will then re-start the pump 26 if the outlet pressure sensor 46 detects a drop in pressure below the pre-set value.

With reference to FIGS. 1 and 2*b* and 3, in the low pressure mode the pump 26 is only required to provide enough pressure in the fluid for it to flow around the loop 30 and back through open valve 38 and return line 40 to the medium pressure station 23. This ensures that the fluid keeps moving and does not thicken or solidify in the pipelines, but because a high pressure is not required, less energy is consumed by the pumps.

Figure 4:
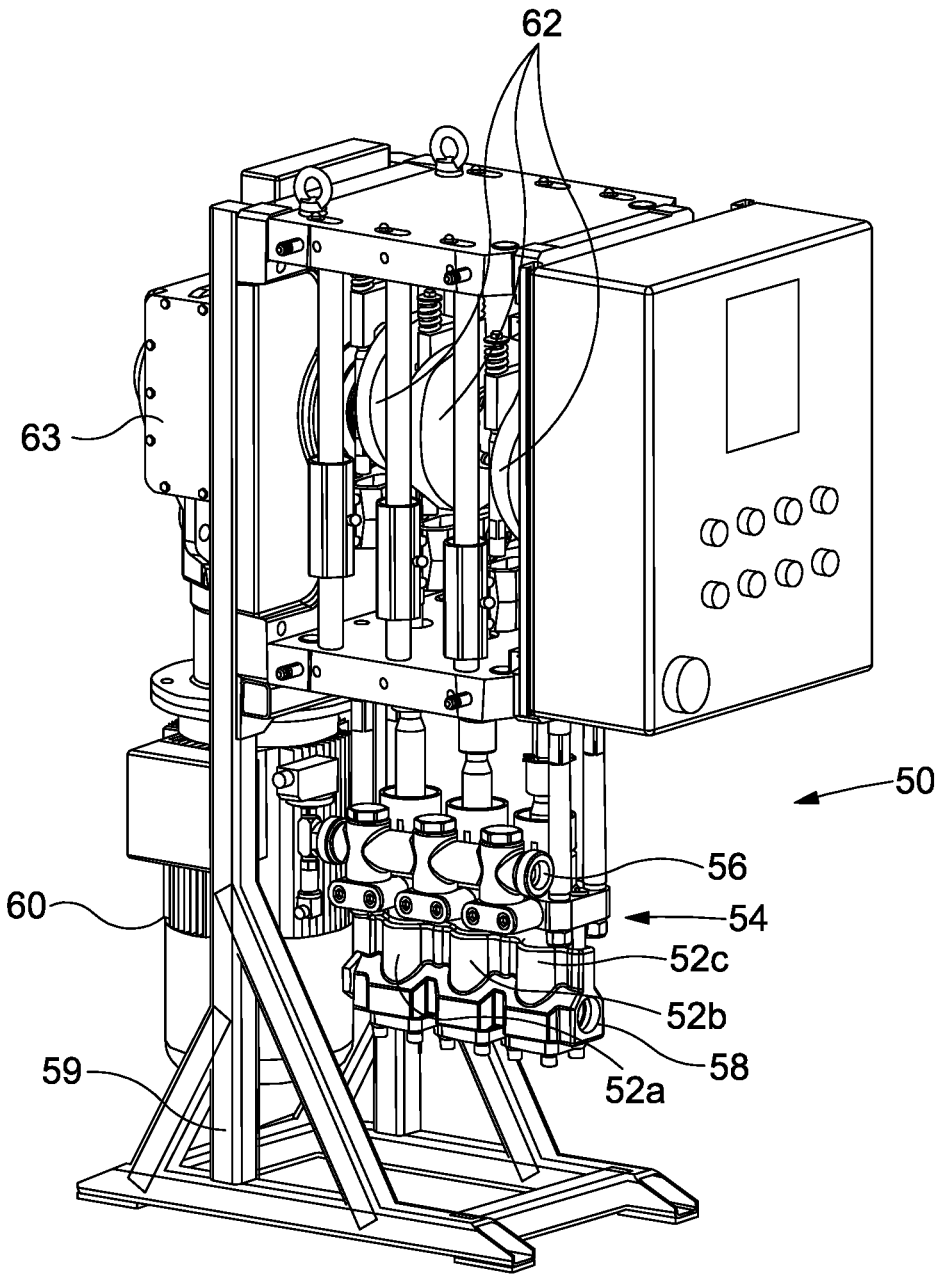
FIG. 4 is an illustration of a high pressure positive displacement pump.

Referring to FIG. 4, there is shown an isometric view of an exemplary positive displacement pump 50, of a type particularly suitable for pump 26 described above in connection with FIG. 1. The pump 50 is an example of a pump of the type described in the applicant's co-pending patent application, GB 1502686.7

As shown in FIG. 4, the positive displacement pump 50 has 3 cylinders 52*a*, 52*b*, 52*c*, each of which has a respective piston (not visible) arranged for reciprocal movement inside it. The cylinders 52*a*, 52*b*, 52*c* are formed in a pump body 54, in which is formed an inlet passage 58 for connection to a supply of fluid to be pumped, and an outlet passage 56 out of which the fluid is pumped. Also housed within the pump body 54 is an arrangement of check valves, each cylinder having an associated inlet check valve and an associated outlet check valve, which ensure that the fluid flows into and out of the pump in one direction as the pistons are moved within the cylinders.

The positive displacement pump 50 is shown mounted to a frame 59, which also supports a variable speed ac motor drive 60 providing a rotational drive to the cam arrangement 62, via a gearbox 63, and a control panel 65. The cam arrangement 62 provides a reciprocating drive to the pistons in the cylinders 52*a*, 52*b*, 52*c*. During the reciprocal cycle, the pistons go through a drawing stroke and a pumping stroke. During the drawing stroke of a cylinder (e.g. cylinder 52*a*), the piston within the cylinder 52*a* moves upwards. The suction of the piston opens the inlet check valve and closes the outlet check valve associated with the cylinder 52*a*. Fluid is drawn along the inlet passage 56, through the associated inlet check valve and into the cylinder 52*a*.

During the pumping stroke, the pistons move downwards within the cylinders. While cylinder 52*a* is on its drawing stroke, the pistons in cylinders 52*b*, 52*c* are on their pumping strokes. The pistons within cylinders 52*b*, 52*c* increase the pressure of the fluid, which causes their associated inlet check valves to close and their associated outlet check valves to open. Fluid is pumped out of the cylinders 52*b*, 52*c*, through the outlet check valves and along the outlet passage 58.

The pistons are driven by a variable speed ac motor 60 coupled to a cam arrangement 62. The cams are shaped such that the drawing stroke occurs over a time period which is no more than half the time period of the pumping stroke. The cams are arranged to drive the pistons out of phase with one another such that at any position during the rotation cycle, at least two of the pistons are pumping. This means that twice the piston area is used to exert pressure on the fluid, thereby generating significantly higher pressure in the fluid than for a single cylinder. This arrangement also results in lower mechanical forces on the cam than would be the case if an equivalent fluid pressure was to be produced by a single piston.

The ac motor 60, which drives the cam arrangement as described above so as to provide a reciprocating drive to the pistons, has an inverter with a closed loop vector drive control. For the pumps described above in a system such as that shown in FIG. 1, it is required to provide and maintain a high pressure to the fluid/mastic even when the quantity of mastic being used is very small (or zero). This means that the pump 26 of FIG. 1 should be capable of maintaining a high pressure with the ac motor 60 maintaining a torque on the cam shaft even when this is not rotating, and this can only happen if the ac motor does not stall. The ac motor 60 is driven by an inverter. The inverter uses a vector control, preferably a closed loop vector control, in which a signal is provided to the inverter indicating the relative positions of the stator and rotor of the motor.

The invention claimed is:

1. A system for delivery of a high viscosity fluid, comprising:

a variable speed pump;

a circuit through which the fluid is pumped by the variable speed pump, the circuit comprising a loop having a plurality of fluid off-takes and comprising at least one valve disposed along the circuit; and a controller configured to control a position of the at least one valve and control operation and speed of the variable speed pump:

(i) to pump the fluid in the circuit in a high pressure mode, wherein the fluid flows from the variable speed pump into the loop and to the plurality of fluid off-takes in opposing flow directions along the loop in the high pressure mode, and wherein the controller is configured to control the speed of the variable speed pump to maintain a pressure of the fluid in the circuit in the high pressure mode, and (ii) to pump the fluid around the circuit, in a single flow direction along the loop, in a low pressure mode during periods when none of the plurality of fluid off-takes are being used.

2. The system of claim 1, wherein in the low pressure mode, the fluid flows from the variable speed pump through a first end of the loop and out through a second end of the loop.

3. The system of claim 1, wherein the system is installed in a manufacturing facility, with the plurality of fluid off-takes located at locations in a product manufacturing area.

4. The system of claim 1, wherein the variable speed pump is located at a booster station, the variable speed pump having an inlet configured to receive the fluid from a medium pressure pumping station.

5. The system of claim 4, wherein the medium pressure pumping station comprises a medium pressure pump and a ram unit, wherein the ram unit is configured to apply pressure to the fluid to force the fluid into an inlet of the medium pressure pump, and wherein the medium pressure pump is configured to pump the fluid to the inlet of the variable speed pump.

6. The system of claim 1, further comprising an outlet pressure sensor configured to monitor a fluid pressure at an outlet of the variable speed pump, wherein the outlet pressure sensor is configured to provide a signal representing the fluid pressure to the controller, and the controller is configured to control the speed of the variable speed pump based on the fluid pressure at the outlet of the variable speed pump.

7. The system of claim 6, further comprising a pressure switch responsive to the fluid pressure at the outlet of the variable speed pump to confirm that operation of the variable speed pump is providing the fluid pressure at the outlet of the variable speed pump below a maximum working pressure of the variable speed pump.

8. The system of claim 1, wherein the variable speed pump is an ac motor driven positive displacement pump.

9. The system of claim 8, wherein the ac motor is driven by an inverter.

10. The system of claim 9, wherein the inverter has a vector drive control.

11. The system of claim 10, wherein the inverter has a closed loop vector drive control.

12. A method of operating a high viscosity fluid delivery system, wherein the system comprises a variable speed pump, and a circuit through which a fluid is pumped, the circuit comprising a loop having a plurality of fluid off-takes and at least one valve disposed along the circuit, the method comprising:

(i) controlling a position of the at least one valve and controlling operation and speed of the variable speed pump to pump the fluid in the circuit in a high pressure mode, wherein the fluid is pumped into the loop and to the plurality of fluid off-takes in opposing flow directions along the loop in the high pressure mode, and to control the speed of the variable speed pump to maintain a pressure of the fluid in the circuit in the high pressure mode, and (ii) controlling the position of the at least one valve and the operation and speed of the pump to pump the fluid around the circuit, in a single flow direction along the loop, in a low pressure mode during periods when none of the plurality of fluid off-takes are being used.

13. The method of claim 12, wherein in the low pressure mode, the fluid is pumped through a first end of the loop and out through a second end of the loop.

14. The method of claim 12, wherein the system comprises a pressure sensor configured to monitor the pressure of the fluid at an outlet of the variable speed pump, and wherein the method further comprises, in the high pressure mode:

detecting, with the pressure sensor, a drop in the pressure of the fluid at the outlet of the variable speed pump below a pre-set fluid pressure;

starting the variable speed pump, or increasing the speed of the variable speed pump; and restoring the pressure of the fluid at the outlet of the variable speed pump to the pre-set fluid pressure.

15. The method of claim 14, further comprising:

detecting, with the pressure sensor that the pressure of the fluid at the outlet of the variable speed pump has been restored to the pre-set fluid pressure;

reducing the speed of the variable speed pump to zero; and while the variable speed pump is at zero speed, using the variable speed pump to maintain a force on the fluid for a predetermined period of time.

16. A system for delivery of a high viscosity fluid, comprising:

a medium pressure pumping station;

a booster station comprising a variable speed pump having an inlet configured to receive the fluid from the medium pressure pumping station;

a circuit through which the fluid is pumped;

a valve disposed along the circuit;

a plurality of fluid off-takes from a loop of the circuit; and a controller configured to control a position of the valve and control operation and speed of the variable speed pump:

(i) to pump the fluid in the circuit in a high pressure mode to provide pressurized fluid to the loop and the plurality of fluid off-takes in opposing flow directions along the loop in the high pressure mode, and wherein the controller is configured to control the speed of the variable speed pump to maintain a pressure of the fluid in the circuit in the high pressure mode, and (ii) to pump the fluid in a single flow direction around the loop in a low pressure mode during periods when none of the plurality of fluid off-takes are being used.

17. The system of claim 16, wherein the medium pressure pumping station comprises a medium pressure pump and a ram unit, wherein the ram unit is configured to apply pressure to the fluid to force the fluid into an inlet of the medium pressure pump, and wherein the medium pressure pump is configured to pump the fluid to the inlet of the variable speed pump.

18. A method of operating a high viscosity fluid delivery system, wherein the system comprises a medium pressure pumping station, a booster station comprising a variable speed pump, a circuit through which a fluid is pumped, a valve disposed along the circuit, and a plurality of fluid off-takes from a loop of the circuit, the method comprising:

(i) pumping the fluid from the medium pressure pumping station to the booster station;

(ii) controlling a position of the valve and controlling operation and speed of the variable speed pump to pump the fluid in the circuit in a high pressure mode to provide pressurized fluid to the loop and the plurality of fluid off-takes in opposing flow directions along the loop and to maintain a pressure of the fluid in the circuit in the high pressure mode; and (iii) controlling the operation and speed of the variable speed pump to pump the fluid in a single flow direction around the loop in a low pressure mode during periods when none of the plurality of fluid off-takes are being used.

* * * * *